United States Patent [19]

Osteen

[11] 3,954,287

[45] May 4, 1976

[54] HOLDER FOR WRITING PAD

[76] Inventor: Belmont D. Osteen, Rte. 18, Box 85, Birmingham, Ala. 35210

[22] Filed: Dec. 19, 1974

[21] Appl. No.: 534,433

[52] U.S. Cl. ..... 281/15 R; 281/29; 281/25 R

[51] Int. Cl.[2] ..... B42D 1/00

[58] Field of Search ..... 281/15 R, 15 B, 19 R, 281/25 R; 402/74, 75, 15, 18

[56] References Cited

UNITED STATES PATENTS

| | | | |
|---|---|---|---|
| 1,120,864 | 12/1914 | Todd | 402/74 |
| 2,027,497 | 1/1936 | Smith | 281/15 R |
| 2,599,768 | 6/1952 | Losch | 281/25 R |

*Primary Examiner*—Jerome Schnall

*Attorney, Agent, or Firm*—Woodford R. Thompson, Jr.

[57] ABSTRACT

A holder is provided for a writing pad having a binding strip extending around and lapping over the top of the pad. A cover for the holder has a front portion extending over the binding strip and the upper side of the pad. A first flap formed integrally with the cover extends over the binding strip and terminates adjacent a free edge of the binding strip. A second flap formed integrally with the first flap extends beneath and in a reverse direction to the first flap with a portion of the binding strip therebetween. A laterally projecting member is carried by the ends of the second flap and a cut-away portion in the cover superjacent the binding strip receives both flaps upon movement of the cover into engagement with the pad.

2 Claims, 6 Drawing Figures

HOLDER FOR WRITING PAD

BACKGROUND OF THE INVENTION

This invention relates to a holder for a writing pad and the like and more particularly to such a holder which permits the pad to be detachably connected to the holder.

As is well known in the art to which my invention relates, many devices have been proposed for detachably connecting a writing pad to a holder therefor. Such means usually comprise complicated spring elements, magnets and the like which are not only expensive to manufacture but are also difficult to maintain is satisfactory working order at all times.

BRIEF SUMMARY OF THE INVENTION

In accordance with my present invention, I provide a holder for a writing pad which embodies a cover having a front portion adapted to extend over the binding strip for the pad. A first flap-like member is connected to the cover in position to extend over the binding strip and terminate adjacent the free edge of the binding strip. A second flap-like member is formed integrally with the first flap-like member and extends beneath and in a reverse direction to the first flap-like member with an adjacent portion of the binding strip extending between the first and second flap-like members. A cut-away portion is provided in the cover above the binding strip in position to receive the flap-like members upon movement of the cover onto the upper side of the pad. Laterally projecting members are carried by the ends of the second flap-like member to facilitate insertion of the second flap-like member beneath the binding strip. Accordingly, the writing pad may be easily attached to my improved holder by merely inserting the pad beneath the flap-like members and then inserting the second flap-like member beneath the edge of the binding strip whereby the binding strip is retained in place between the first and second flap-like members.

DESCRIPTION OF THE DRAWINGS

Writing pad holders embodying features of my invention are illustrated in the accompanying drawings, forming a part of this application, in which:

Referring now to the drawings for a better understanding of my invention, I show in FIGS. 1–3 a holder 10 for a writing pad 11. As shown in FIGS. 2 and 3, the writing pad 11 has the usual sheets 12 which are secured in place by a binding strip 13 which extends around the upper edges of the sheets 12 and laps over the top of the sheets to provide an overlapping free edge 14. The binding strip 13 may comprise the usual, generally horizontal strip 16 which extends over the upper side of the pad 10, as shown in FIG. 3, and a relatively thin sheet of material 17 which extends from the back of the pad 10 across the free edges of the sheets 12 and then overlaps the upper edge of the strip of material 16. The pad 11 may also be provided with the usual back sheet 18 which is formed of a relatively thick material. Also, the sheets 12 are secured to each other and to the binding strip 13 by suitable means, such as staples 19, as shown in FIG. 3.

Figure 3:
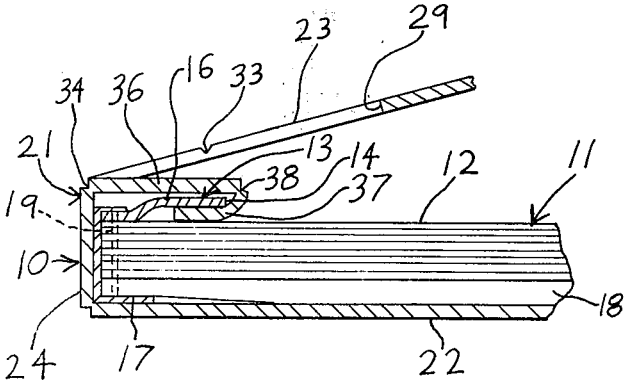
FIG. 3 is an enlarged, sectional view taken generally along the line 3—3 of FIG. 1.

The holder 10 comprises a cover 21 which is shown as embodying a back portion 22 and a front portion 23 which is adapted to extend over the pad 11, as shown. The back portion 22 is connected to the front portion 23 of the cover by an intermediate portion 24 which extends alongside the secured edges of the sheets 12, as shown in FIG. 3. Preferably, the portions 22, 23 and 24 are formed as an integral member whereby the entire cover may be made from a single sheet of material.

Figure 1:
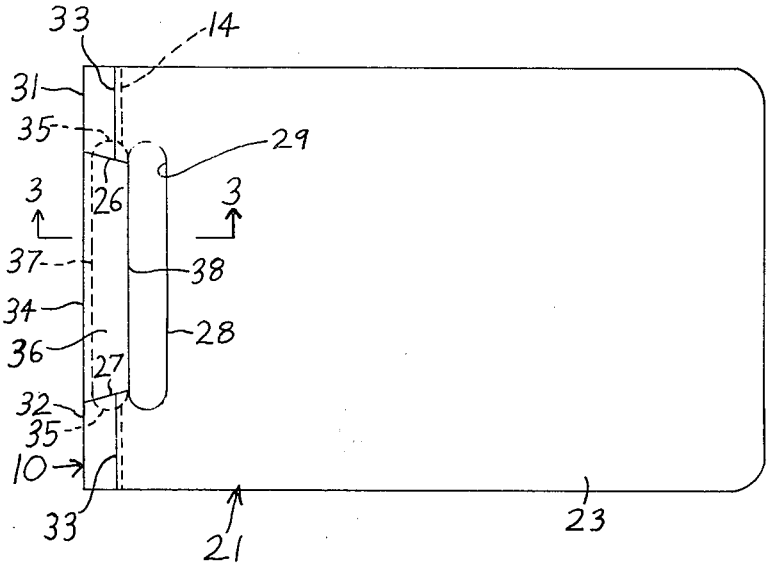
FIG. 1 is a top plan view showing the holder in the closed position.

As shown in FIG. 1, the upper member 23 of the cover 21 is cut along lines 26 and 27 and along line 28 with the lines 26 and 27 intersecting the line 28 to thus provide a cut-away portion 29 in the upper portion 23 of the cover 21. The upper portion 23 of the cover is thus hingedly connected to the intermediate portion 24 along lines 31 and 32 outwardly of the lines 26 and 27, respectively. To facilitate bending the upper member 23 of the cover 21, the member 23 is scored along lines 33 whereby the member 23 may be bent along the lines 33 and the lines 31 and 32 as the member 23 is rotated in a counter-clockwise direction, as viewed in FIGS. 2 and 3. However, if desired, the scored lines 33 may be omitted whereby the member 23 of the cover 21 would hinge about the lines 31 and 32 only.

The cut-away material between the lines 26 and 27 does not move with the member 23 of the cover 21 as the member 23 is pivoted relative to the intermediate portion 24 of the cover. The material intermediate the cut-away lines 26 and 27 is connected to the intermediate portion 24 along a line 34 to thus provide a first flap-like member 36 which is in position to extend over the binding strip 13 and terminate adjacent the free edge 14 of the binding strip, as shown in FIG. 3. A second flap-like member 37 is connected to the first flap-like member 36 along a line 38 and extends beneath and in reverse direction relative to the first flap-like member 36 with the adjacent edge portion 14 of the binding strip 13 therebetween, as shown in FIG. 3. Accordingly, the flap-like member 37 is integrally connected to the flap-like member 36 and is adapted to be moved downwardly and inwardly therebeneath whereby it extends beneath the binding strip 13, as shown. To facilitate insertion of the flap-like member 37 beneath the binding strip 13, I provide lateral projections 35 at each end of the flap-like member 37 which extend beyond the ends of the flap-like member 36, as shown in dotted lines in FIG. 1. That is, a projection 35 at one end of the flap-like member 37 is first inserted beneath the binding strip 37 whereupon the remainder of the flap-like member 37 is then forced easily into place beneath the binding strip. Each projection 35 thus provides a tap which may be inserted beneath the edge 14 of the binding strip 13 outwardly of the flap-like member 36 whereby the projection 35 is in easy reach and may be seen as it is inserted beneath the strip 13.

Figure 2:
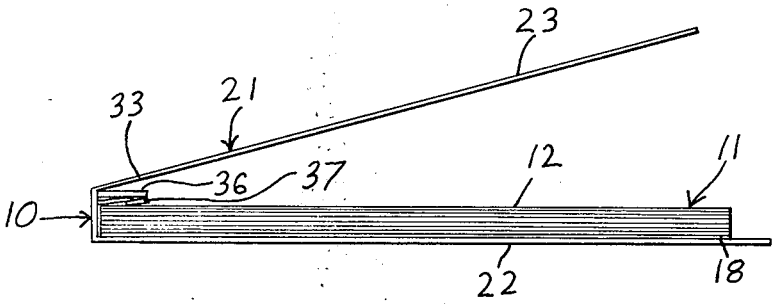
FIG. 2 is a side elevational view of the holder showing the front cover thereof in a slightly raised position.

From the foregoing description, the operation of my improved holder shown in FIGS. 1–3 will be readily understood. To attach the writing pad 11 to the holder 10, the front member 23 of the cover 21 is pivoted in a counterclockwise direction, as viewed in FIGS. 2 and 3, whereby the pad 11 may be moved to a position beneath the flap-like members 36 and 37. The flap-like member 37 is then bent downwardly and inwardly beneath the flap-like member 36 and is inserted beneath the binding strip 13 by first inserting a projection 35 and then forcing the remainder of the member 37 into place, as shown in FIG. 3. The engagement of the free edge 14 of the binding strip 13 with the reversely extending flap-like member 37 thus prevents outward movement of the pad 11 until the flap-like member 37 is removed from the position shown in FIG. 3. Accordingly, the pad 11 may be readily installed and removed from the holder 10.

Figure 4:
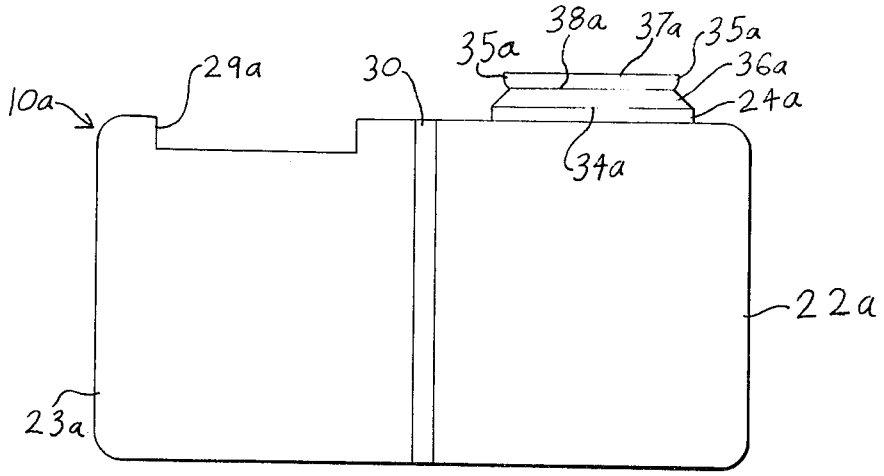
FIG. 4 is a top plan view showing a modified form of my invention, the cover for the holder being in open position and the writing pad being omitted for the sake of clarity.
Figure 5:
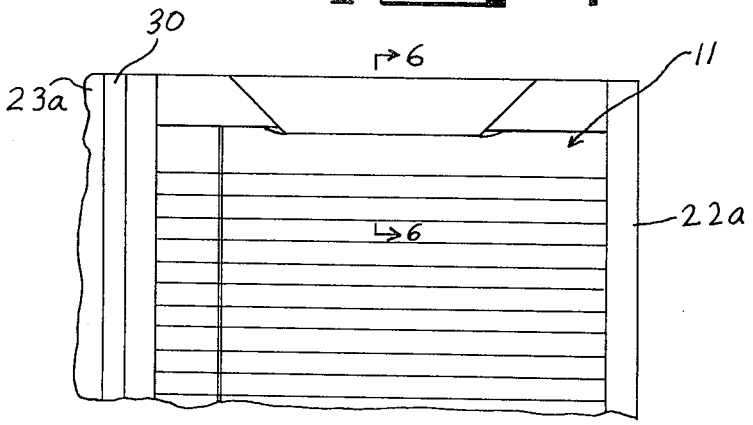
FIG. 5 is an enlarged, fragmental view, showing the upper portion of the holder shown in FIG. 4 with a writing pad attached thereto; and, FIG. 6 is an enlarged, sectional view taken generally along the line 6—6 of FIG. 5.
Figure 6:
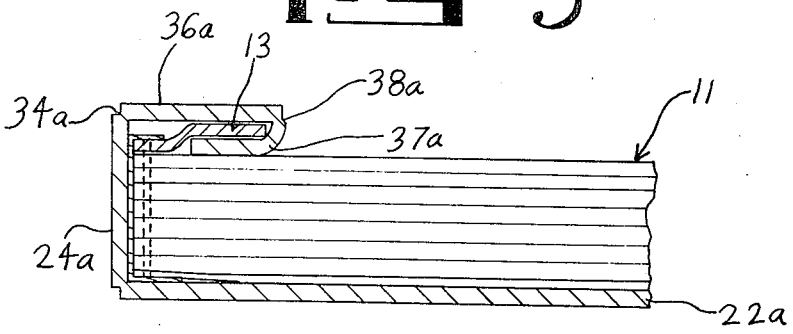

Referring to FIGS. 4, 5 and 6 of the drawing, I show a modified form of my invention in which a holder 10*a* comprises a back portion 22*a* and a front portion 23*a* which are connected to each other by an intermediate portion 30. The front portion 23*a* is adapted to pivot over the back portion 22*a* whereby a writing pad 11 may be secured in place therebetween. Formed integrally with the upper edge of the back portion 22*a* is an upstanding portion 24*a* which is connected to a first flap-like member 36*a* along a line 34*a* whereby the member 36*a* is formed integrally with the member 24*a*. A second flap-like member 37*a* is connected to the flap 36*a* along a line 38*a* whereby the member 37*a* is connected integrally with the member 36*a*, as shown in FIGS. 4 and 6. The flap-like member 37*a* is provided with end projections 35*a* and is adapted to extend beneath and in a reverse direction relative to the flap-like member 36*a* with an adjacent portion of the binding strip 13 therebetween, as shown in FIG. 6.

A cut-out portion 29*a* is provided in the front cover 23*a*, as shown in FIG. 4, in alignment with the flap-like members 36*a* and 37*a* while the front portion 23*a* is in the closed position. The operation of the holder 10*a* shown in FIGS. 4, 5 and 6 is substantially identical to the operation of the holder shown in FIGS. 1, 2 and 3, the principal difference being the fact that the front cover 23*a* pivots laterally over the writing pad and the back portion 22*a* in the embodiment shown in FIGS. 4–6. With the embodiment shown in FIGS. 1, 2 and 3, the front portion 23 pivots upwardly and over the top of the writing pad 11.

From the foregoing, it will be seen that I have devised an improved holder for writing pads and the like. By providing the flap-like member which extends over the binding strip and a second flap-like member formed integrally therewith and adapted to extend beneath the binding strip, the holder is extremely simple of construction, economical of manufacture and a writing pad may be easily and quickly attached thereto and removed therefrom. Also, by forming the securing flaps integrally with the cover member for the holder, the holder may be formed from a single sheet of material.

While I have shown my invention in two forms, it will be obvious to those skilled in the art that it is not so limited, but is susceptible of various other changes and modifications without departing from the spirit thereof.

What I claim is:

1. In a holder for a writing pad having sheets secured in place by a binding strip which extends around the upper edges of and laps over the top of said sheets to provide an overlapping free edge, a. a cover for said pad having a front portion thereof extending over the upper side of said pad, a back portion extending along the lower side of said pad and an intermediate portion connecting said front and back portions.

b. a first flap-like member connected to said cover and extending over said binding strip and terminating adjacent said overlapping free edge of said binding strip, c. a second flap-like member formed integrally with said first flap-like member and extending beneath and in a reverse direction relative to said first flap-like member with the adjacent portion of said binding strip therebetween, d. a lateral projection carried by at least one end of said second flap-like member and extending beyond an end of said first flap-like member adjacent thereto facilitating insertion of said second flap-like member beneath said binding strip, and e. there being a cut-away portion in said front portion of said cover superjacent said binding strip receiving said first flap-like member upon movement of said cover into engagement with said upper side of the pad said first and second flap-like members being cut-out sections from said front portion which form said cut-away portion in said cover, and said first flap-like member being connected to the upper edge of said intermediate portion.

2. A holder for a writing pad as defined in claim 1 in which said first flap-like member is formed integrally with said cover.

* * * * *